US008403378B2

(12) United States Patent
Okada et al.

(10) Patent No.: US 8,403,378 B2
(45) Date of Patent: Mar. 26, 2013

(54) DOOR LATCH DEVICE FOR A VEHICLE

(75) Inventors: Hiroshi Okada, Nirasaki (JP); Satoru Nishizawa, Nirasaki (JP); Nao Mizumoto, Nirasaki (JP)

(73) Assignee: Mitsui Mining and Smelting Co., Ltd., Tokyo (JP)

( * ) Notice: Subject to any disclaimer, the term of this patent is extended or adjusted under 35 U.S.C. 154(b) by 83 days.

(21) Appl. No.: 11/771,028

(22) Filed: Jun. 29, 2007

(65) Prior Publication Data

US 2008/0122230 A1 May 29, 2008

(30) Foreign Application Priority Data

Jul. 3, 2006 (JP) ..... 2006-183572

(51) Int. Cl.
*E05C 3/06* (2006.01)
*E05C 3/16* (2006.01)

(52) U.S. Cl. ..... 292/201; 292/216; 292/DIG. 23

(58) Field of Classification Search ..... 292/201, 292/216, 259 A, DIG. 23
See application file for complete search history.

(56) References Cited

U.S. PATENT DOCUMENTS

| | | | | |
|---|---|---|---|---|
| 3,705,738 | A * | 12/1972 | Yoshimura | 292/216 |
| 5,118,146 | A * | 6/1992 | Watanuki | 292/216 |
| 5,947,536 | A * | 9/1999 | Mizuki et al. | 292/201 |
| 6,076,868 | A * | 6/2000 | Roger et al. | 292/201 |
| 6,109,671 | A * | 8/2000 | Roncin et al. | 292/216 |
| 6,131,337 | A * | 10/2000 | Machida | 49/280 |
| 6,223,468 | B1 * | 5/2001 | Kobayashi | 49/280 |
| 6,364,379 | B1 * | 4/2002 | Roberts et al. | 292/216 |
| 6,378,920 | B1 * | 4/2002 | Ostrowski et al. | 292/216 |
| 6,422,615 | B1 * | 7/2002 | Roos et al. | 292/216 |
| 6,422,617 | B1 * | 7/2002 | Fukumoto et al. | 292/216 |
| 6,499,776 | B2 * | 12/2002 | Takamura | 292/201 |
| 6,550,826 | B2 * | 4/2003 | Fukushima et al. | 292/201 |
| 6,565,132 | B2 * | 5/2003 | Mork et al. | 292/216 |
| 6,637,783 | B2 * | 10/2003 | Takamura | 292/201 |
| 6,698,804 | B2 * | 3/2004 | Shiota et al. | 292/201 |
| 6,988,749 | B2 * | 1/2006 | Hashiba et al. | 292/201 |
| 2003/0038485 | A1 * | 2/2003 | Schwaiger et al. | 292/201 |
| 2003/0227177 | A1 * | 12/2003 | Matsuda et al. | 292/216 |
| 2004/0239124 | A1 * | 12/2004 | Larsen et al. | 292/201 |
| 2005/0040656 | A1 * | 2/2005 | Taga | 292/201 |

FOREIGN PATENT DOCUMENTS

| | | | |
|---|---|---|---|
| FR | 2753738 | A1 * | 3/1998 |
| JP | 2005-68722 | A | 3/2005 |

OTHER PUBLICATIONS

Computer-Generated Translation of FR2753738 using the EPO website, http://translationportal.epo.org.*

* cited by examiner

*Primary Examiner* — Carlos Lugo
*Assistant Examiner* — Alyson M Merlino
(74) *Attorney, Agent, or Firm* — Davis & Bujold, PLLC

(57) ABSTRACT

A base plate is fixed to one of a door and a vehicle body of a vehicle. A latch is pivotally secured to the base plate and engages with a striker of the other of the door and the vehicle body, thereby connecting the door to the vehicle body. A ratchet is pivotally secured to the base plate and engages with the latch to allow the door to be held in a closed position. The base plate is fixed to the door or vehicle body with bolts. The striker which engages with the latch is positioned substantially on a straight line between center of the two bolts.

3 Claims, 10 Drawing Sheets

DOOR LATCH DEVICE FOR A VEHICLE

This application claims priority from Japanese Application Serial No. 2006-183572 filed Jul. 3, 2006.

BACKGROUND OF THE INVENTION

The present invention relates to a door latch device for a vehicle comprising a door which can be opened and closed about a hinge shaft, the device enabling the door to be held in a closed position.

In JP2005-68722A, a hatch door is pivotally secured at the rear part of a vehicle body about a hinge shaft at the top to open and close up and down. A door latch device for holding the hatch door in a closed position comprises a base plate fixed to the hatch door with bolts; a latch pivotally secured to the back plate for holding the hatch door at the closed position by engagement with a striker of the vehicle body; and a ratchet pivotally secured to the back plate to engage with the latch to prevent the latch from turning in a door-opening direction.

In the door latch device therein, an axial direction of bolts for fixing right and left mounting portions of the base plate to the hatch door is different from an opening direction of the hatch door. Opening load of the hatch door which acts between the latch and the striker is applied to the bolts obliquely. As a result, the mounting portion of the base plate and the surface of the hatch door to which the mounting portion is fixed with the bolts are obliquely deformed and are likely to be subject to decrease in strength, so that the base plate and others have to be made in larger size.

SUMMARY OF THE INVENTION

In view of the disadvantages in the prior art, it is an object of the invention to provide a door latch device for a vehicle improving a binding position of a device for fixing a base plate to a door to enable strength to increase.

BRIEF DESCRIPTION OF THE DRAWINGS

The features and advantages of the invention will become more apparent from the following description with respect to embodiments as shown in accompanying drawings wherein.

DETAILED DESCRIPTION OF PREFERRED EMBODIMENT

Figure 1:
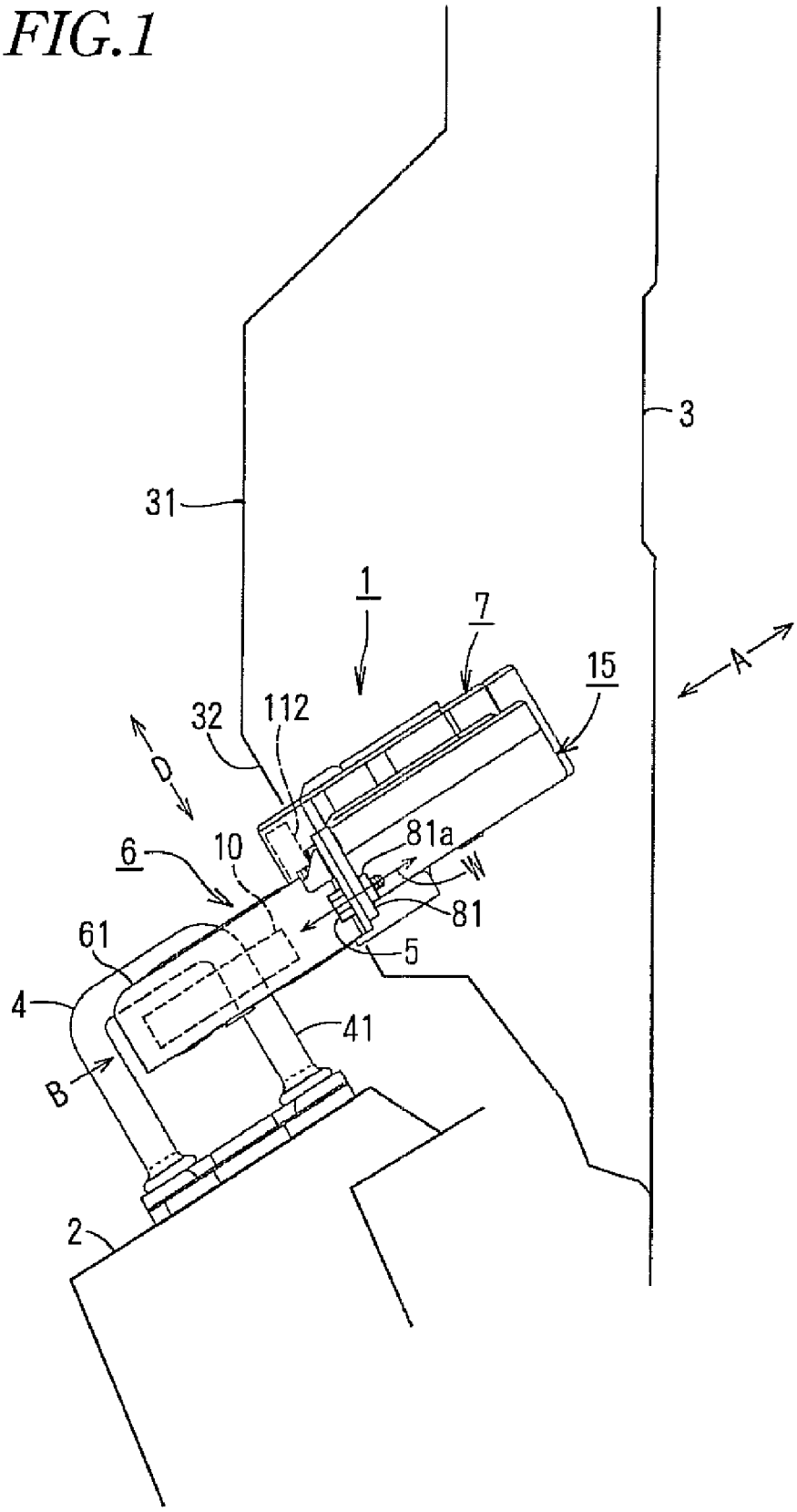
FIG. 1 is a vertical sectional side view of the lower part of a hatch door to which the present invention is applied.

In the following description, the left side in FIG. 1 is the front of a vehicle, and the right side is the rear of the vehicle. The back in FIG. 2 and the front in FIG. 3 are the front of a latch device, and the front in FIG. 2 and the back in FIG. 3 are the rear.

Figure 2:
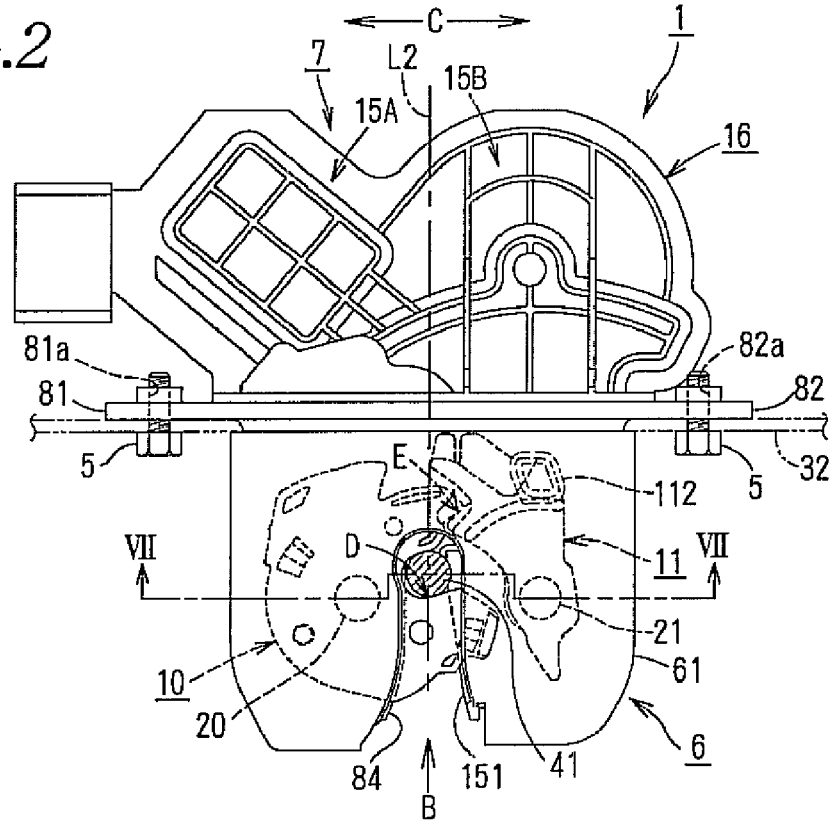
FIG. 2 is a rear view of the latch device.
Figure 3:
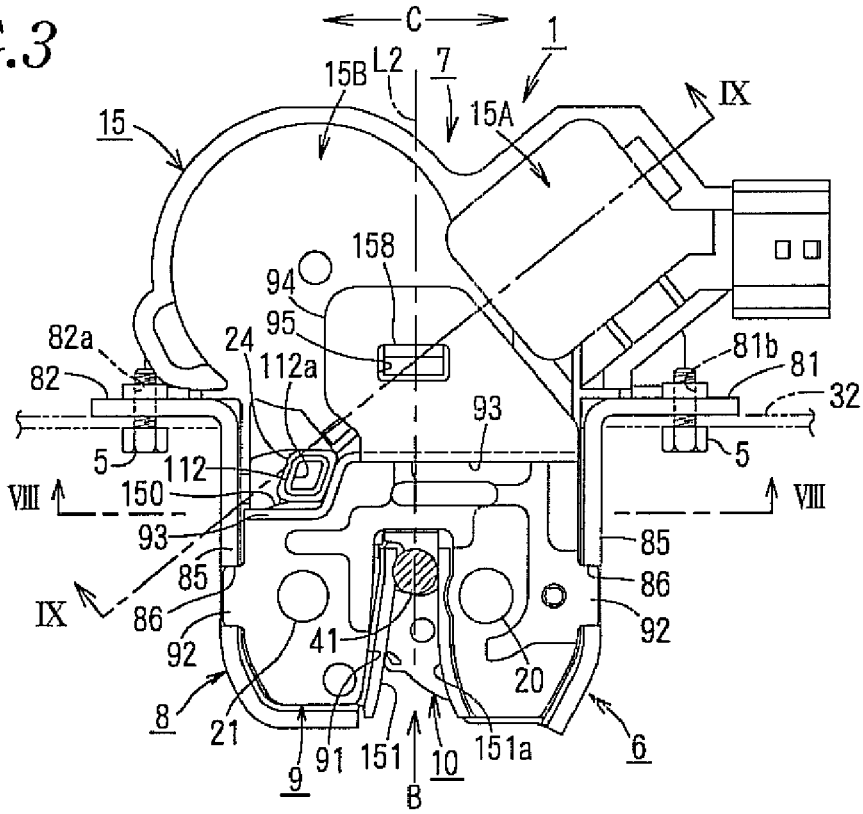
FIG. 3 is a front view thereof.

In FIGS. 1-3, the latch device 1 comprises an engagement portion 6 for holding in a closed position a hatch door 3 which opens and closes up and down about a hinge shaft (not shown) at the rear of the vehicle; and a driving portion 7 for releasing the engagement portion 6. At a lower part of an inner panel 31 of the hatch door 3, the engagement portion 6 is exposed from the hatch door 3 and the driving portion 7 is stored in the hatch door 3.

The latch device in FIG. 1 is tilted, but may be mounted vertically depending on the shape and a closing direction of the hatch door and mounting position of a striker 4 described later.

The engagement portion 6 engages with an engagement rod 41 of the inverted-U shaped striker 4 fixed to a vehicle body 2 thereby holding the hatch door 3 in a substantially vertical closed position in FIG. 1. The outer surface of the engagement portion 6 which projects from the inner panel 31 of the hatch door 3 is covered with a synthetic-resin cover 61 to improve appearance. For better understanding, the cover 61 is shown only in FIGS. 1, 2, 4 and 7 and omitted in the other views.

Figure 4:
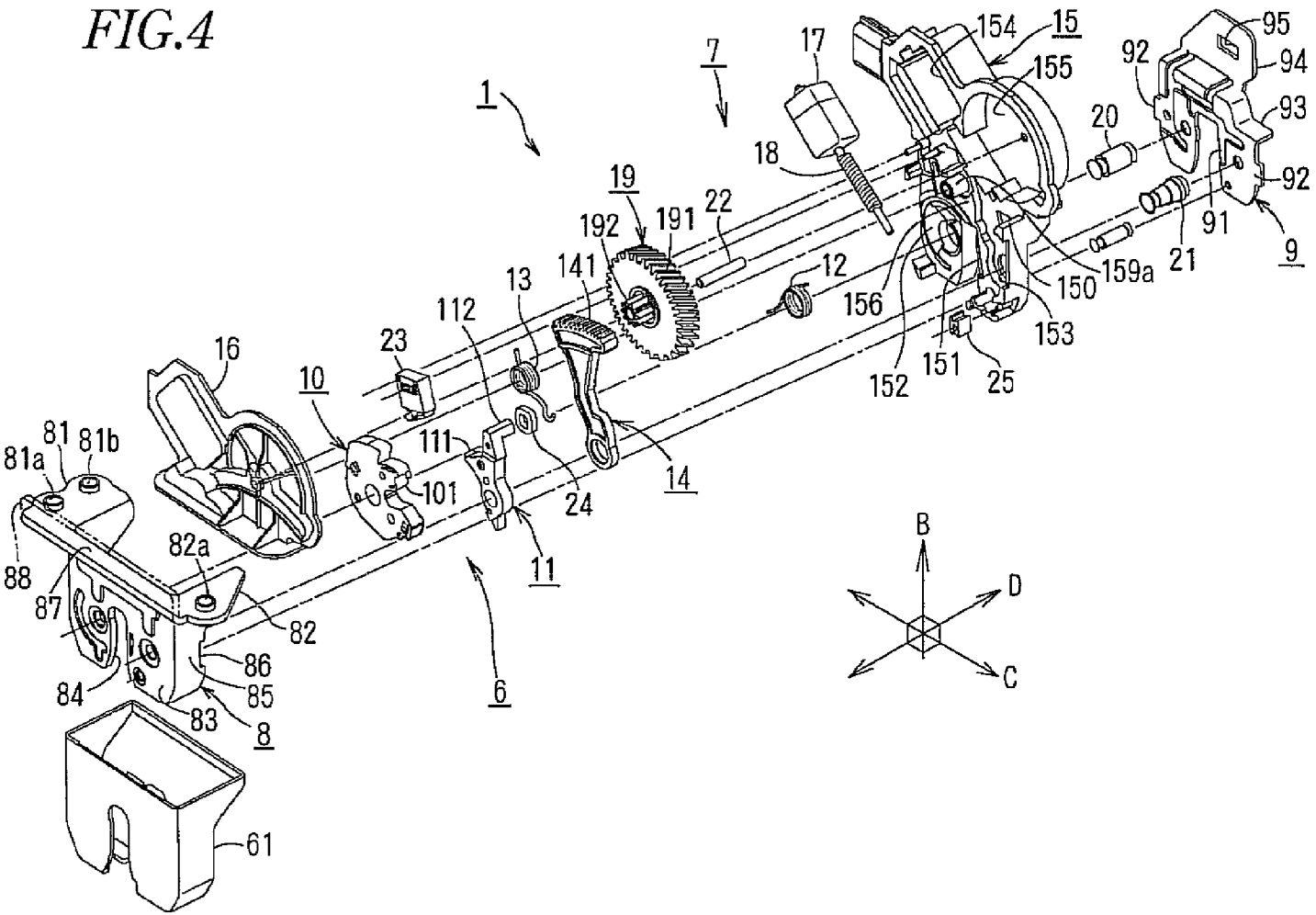
FIG. 4 is an exploded perspective view of a latch device according to the present invention.
Figure 5:
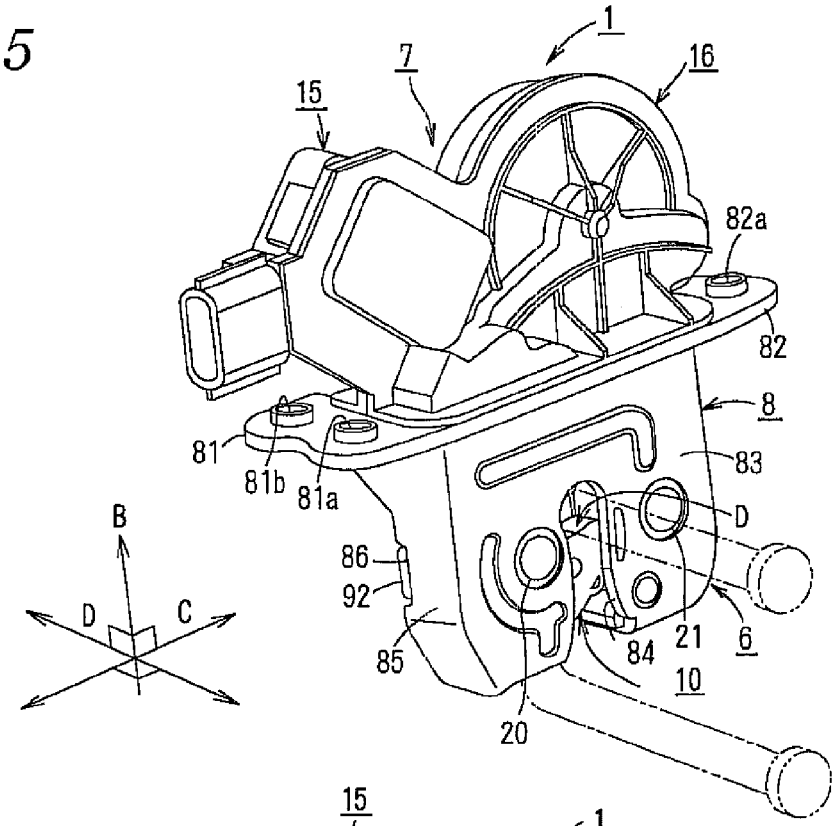
FIG. 5 is a rear perspective view of the latch device.
Figure 10:
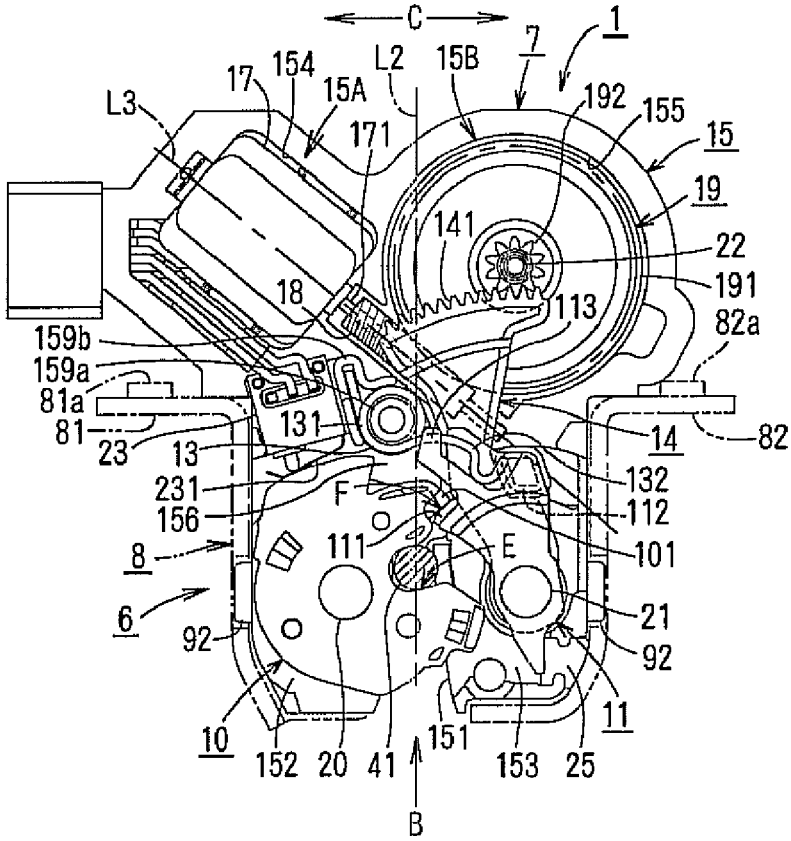
FIG. 10 is a rear view of the latch device from which a cover and a base plate are removed.
Figure 11:
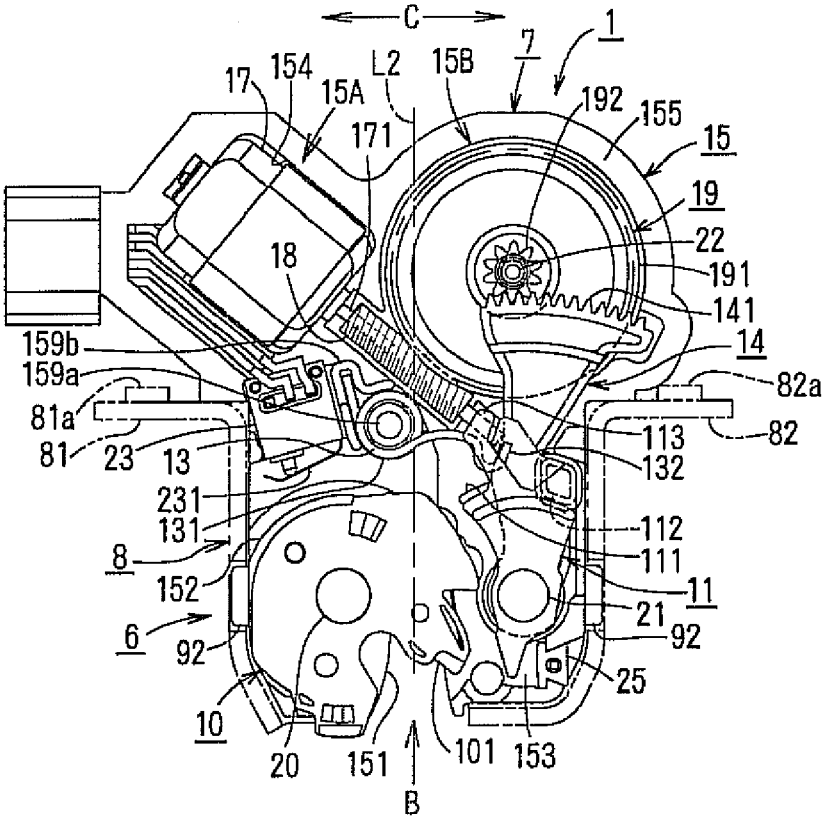
FIG. 11 is a rear view of the latch device from which the cover and base plate are removed.
Figure 12:
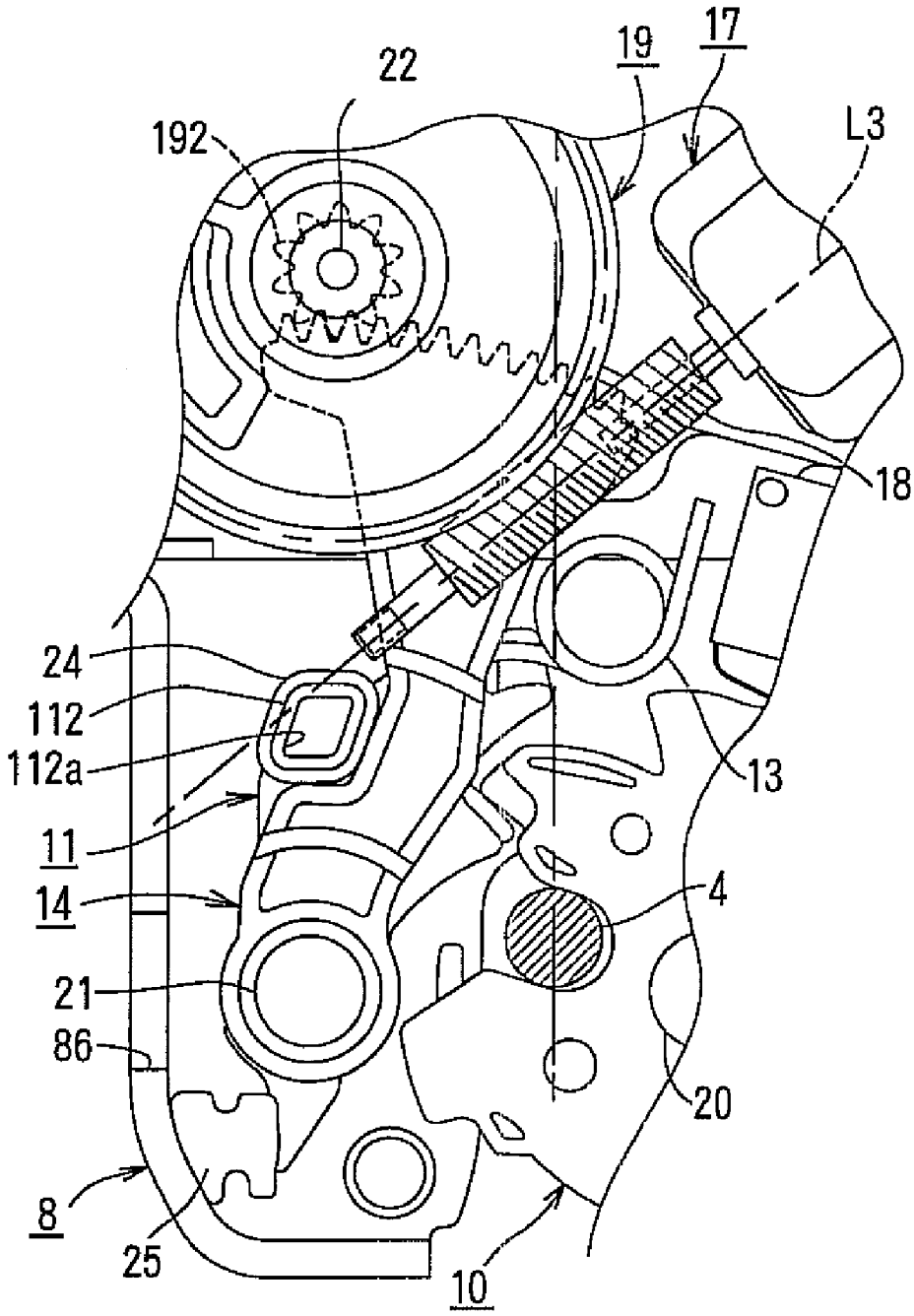
FIG. 12 is an enlarged front view of the main part.

In FIG. 4, the engagement portion 6 comprises a metal base plate 8 fixed to the inner panel 31 of the hatch door 3; a latch 10 which can engage with the striker 4; a ratchet 11 which can engage with the latch 10; a latch spring 12 for forcing the latch 10 in an opening direction or a clockwise direction in FIGS. 2, 10 and 11; a ratchet spring 13 for forcing the ratchet 13 in an engagement direction or an anticlockwise direction in FIGS. 2, 10 and 11; and a turning-position sensor 23 for detecting a rotational position of the latch 10.

The driving portion 7 comprises an upper part of the synthetic-resin housing 15; a synthetic-resin cover 16 for closing an upper rear part of the housing 15; a motor 17; a worm 18 fixed to a shaft 171 of the motor 17; and a worm wheel 19 which meshes with the worm 18.

Mounting portions 81,82 of a base 83 projecting from the inner panel 31 of the hatch door 3 is coupled to a mounting surface 32 at the lower part of the inner panel 31 with bolts 5 and female threads 81*a*,81*b*,82*a* which engage with the bolts 5. The mounting surface 32 is perpendicular to an opening direction A of the hatch door 3 in FIG. 1, so that the base plate 8 is fixed to the hatch door 3. At the lower side of the middle of the base 83, a groove 84 in which the striker 4 engages when the hatch door 3 is closed is formed along a striker engagement direction B or a direction opposite to a closing direction of the hatch door 3.

The right and left mounting portions 81,82 have surfaces perpendicular to the opening direction of the hatch door 3 and are spaced apart from each other along a direction of an axis of a hinge shaft. In the right and left mounting portions 81,82, there are the female threads 81*a*,81*b*,82*a* in which the bolt 5 extending perpendicular to the mounting surface 32 of the hatch door 3 and the surfaces of the mounting portions 81,82 or in the opening direction A of the hatch door engages.

To fix the latch device 1 to the hatch door 3, while the right and left mounting portions 81,82 of the base plate 8 is pressed on the mounting surface 32 of the inner panel 31, the bolt 5 is inserted in a bore (not shown) of the mounting surface 32 and engaged with the female threads 81*a*,81*b*,82*a* to allow the mounting portions 81,82 to be joined to the mounting surface 32 of the inner panel 31.

Figure 7:
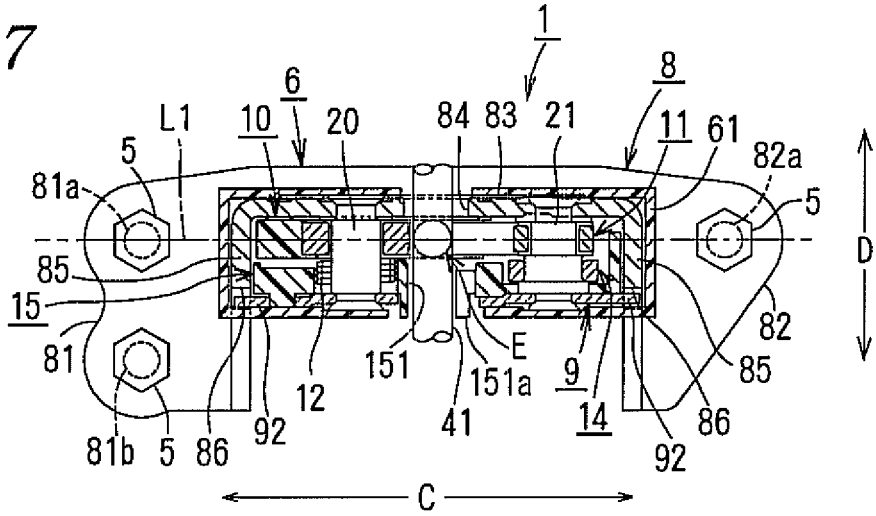
FIG. 7 is a horizontal sectional view taken along the line VII-VII in FIG. 2.
Figure 8:
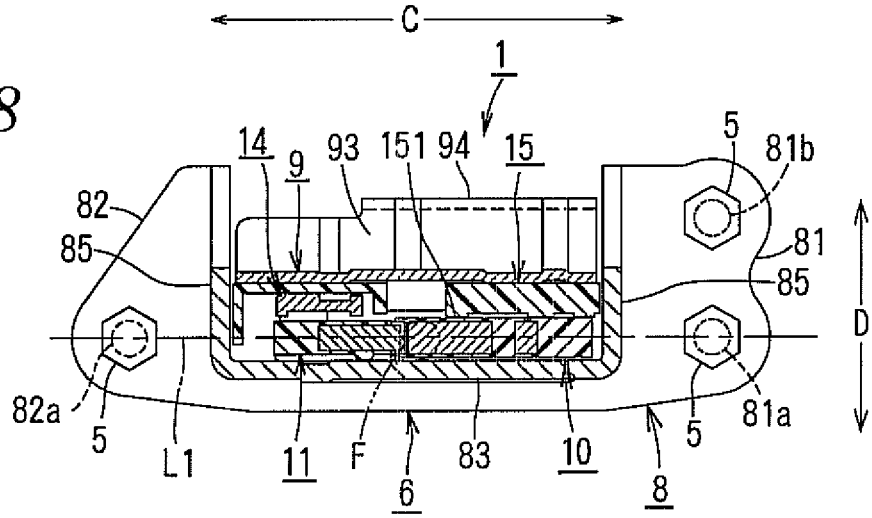
FIG. 8 is a horizontal sectional view taken along the line VIII-VIII in FIG. 3.

In FIGS. 7 and 8, the left mounting portion 81 (right in FIG. 8) is broader than the right mounting portion 82 (left in FIG. 8). The left mounting portion 81 has the two female threads 81*a*,81*b*, while the left mounting portion 82 has the one female thread 82*a*.

In this embodiment, the number of the female threads in the left mounting portion 81 is larger than that of the female threads in the right mounting portion 82. But the present invention is not limited to this, and the number of female threads in the right and left mounting portions 81,82 may be equal to each other. As shown by a dotted line in FIG. 4, an upward bent portion 88 may be provided on a connecting portion 87 between the right and left mounting portions 81 and 82 to increase rigidity of the base plate 8. The mounting portion 82 is smaller than the mounting portion 81. If the portions 82 and 83 have the same size, rigidity of the base plate 8 can be improved.

In FIGS. 7 and 8, a straight line L1 between the female thread 81*a* of the left mounting portion 81 and the female thread 82*a* of the right mounting portion 82 is parallel with the hinge axis C. The female thread 81*b* of the left mounting portion 81 is deviated from the straight line L1.

A binding device of the present invention comprises the bolts 5 which engage in the female threads 81*a*,81*b*,82*a* of the mounting portions 81,82, but the present invention is not limited to those. For example, the binding device may comprise weld bolts fixed to the mounting portions 81,82 by welding and nuts which engage with the weld bolts; weld nuts fixed to the mounting portions 81,82 by welding and bolts which engage with the weld nuts; bores of the mounting portions 81,82 and tapping screws which engage in the bores; or weld bolts welded to the surface of the inner panel 31 and nuts which engage with the weld bolts put in bores of the mounting portions 81,82.

The mounting portions 81,82 are formed at the sides of the base 83 of the base plate 8, and side portions 85,85 bent at right angles with respect to the base 83 are provided to increase rigidity of the base 83.

A housing 15 faces the base 83 and is fixed to the front face of the base plate 8 between the side portions 85 and 85.

At the lower middle part of the housing 15, there is a striker-fitting groove 151 which is coincident with the striker-fitting groove 84 of the base plate 8. On the rear surface of the housing 15, there are a latch-connecting region 152 on which the latch 10 fits; a ratchet-connecting region 153 on which the ratchet 11 fits; a motor-connecting region 154 on which the motor 17 fits; a worm-wheel-connecting region 155 on which the worm wheel 19 fits; and a spring-connecting region 156 on which the ratchet spring 13 and a turning-position sensor 23 fit.

The latch-connecting region 152 is formed at a left lower part of the housing 15. The motor-connecting region 154 is above the latch-connecting region 152. The ratchet-connecting region 153 is at a right lower part of the housing 15 and at right side of the latch-connecting region 152. The worm-wheel-connecting region 155 is above the ratchet-connecting region 153 and at right side of the motor-connecting region 154. The spring-connecting region 156 is formed almost like a triangle between the motor 17 and ratchet 10 by tilting the motor 17 as described later.

In FIGS. 10 and 11, a straight boarder line L2 passes through the striker-fitting grooves 84,151 along a striker-fitting direction. In the base plate 8 and housing 151*a* left side or one side of the boarder line is called the first area 15A, while a right side or the other side thereof is called the second area 15B. The first area 15A comprises the latch-connecting region 152, motor-connecting region 154, spring-connecting region 156 and the mounting portion 81 fixed to the mounting surface 32 of the hatch door 3 with the two bolts 5. The second area 15B comprises the ratchet-connecting region 153, the worm-wheel-connecting region 155, and the right portion 82 fixed to the mounting surface 32 of the hatch door 3 with the one bolt 5.

The left mounting portion 81 in the first area 15A including the latch 10 is fixed to the mounting surface 32 of the hatch door 3 with the two bolts 5, so that the left mounting portion 81 is firmly fixed to the mounting surface 32. The bolts 5 for fixing the left mounting portion 81 to the mounting surface 32 of the hatch door 3 is more in number than the bolts 5 for fixing the right mounting portion 82 to the mounting surface 32 of the second area 15B, so that the left mounting portion 81 of the first area 15A to which load is likely to act can be firmly fixed to the mounting surface 32.

Figure 9:
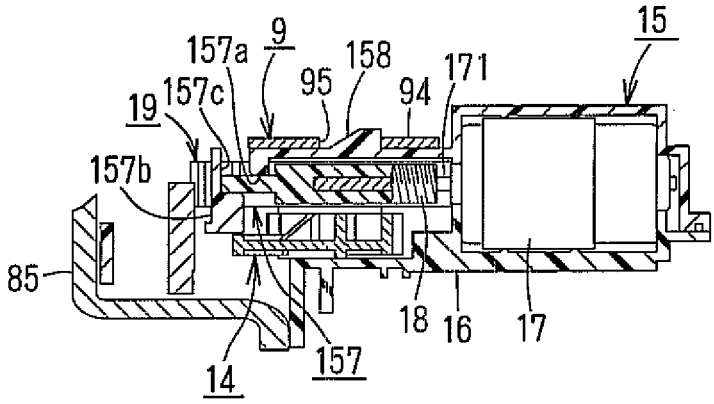
FIG. 9 is a horizontal sectional view taken along the line IX-IX in FIG. 3.
Figure 13:
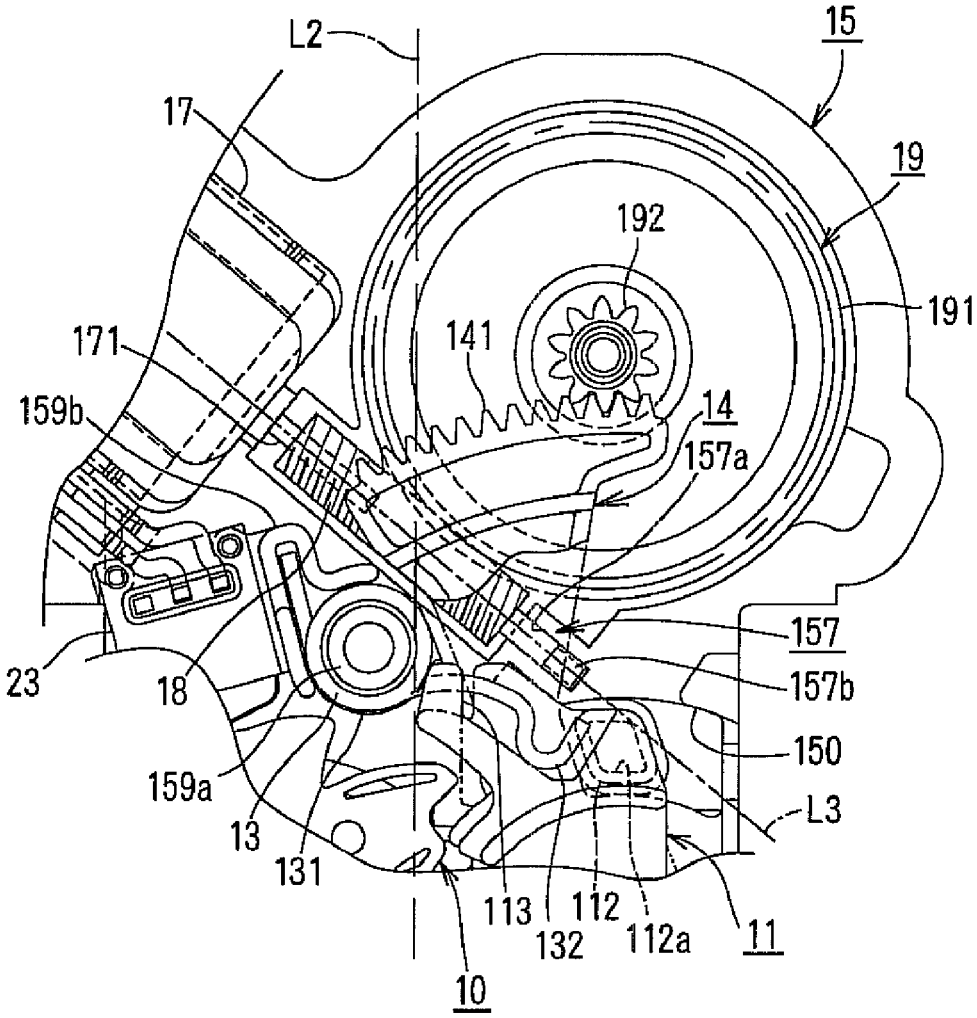
FIG. 13 is an enlarged rear view thereof.

Between the ratchet-connecting region 153 and the worm-wheel-connecting region 155 of the housing 15, a radial-bearing region 157 which rotatably supports the entire circumference of the end of the worm 18 is integrally formed. In FIGS. 9 and 13, the radial-bearing region 157 comprises a recess 157*a* in which the end of the worm 18 engages, and a holding portion 157*b* which obliquely faces the recess 157*a*. In FIG. 9, there is a rapping hole 157*c* on the surface facing the holding portion 157*b* in the housing 15 when the holding portion 157*b* is molded from synthetic resin.

The end of the worm 18 axially extends between the recess 157*a* and the holding portion 157*b*, so that it is rotatably supported in the radial-bearing region 157. It prevents the worm 18 from radially loosening and supports the end of the worm 18. As a result, when the opening lever 14 crosses the worm 18 as described later, even if the cover 16 cannot partially hold the end of the worm 11 radially by the opening lever 14, the end of the worm 18 is prevented from loosening radially by the recess 157*a* and the holding portion 157*b* to enable the end to be supported rotatably.

The back plate 9 is fixed to the front lower part of the housing 15 and fixed to the base plate 8 together with the housing 15, so that the back plate 9 fits between the right and left side portions 85 and 85, and the right and left projections 92,92 at each side are disposed in recesses 86,86 of the side portions 85,85 of the base plate 8. At the lower part of the back plate 9, the striker-fitting groove 91 engages with a flange 151*a* surrounding the striker-fitting groove 151 of the housing 15.

At the upper part of the back plate 9 or above the striker-fitting groove 91, a flange 93 extends in the hinge-axis direction C and is bent at almost right angles to extend forwards or in the pivot direction D, crossing an extension of the striker-fitting groove 91. A holding portion 94 is bent upward at almost right angles at the front end of the flange 93.

Figure 6:
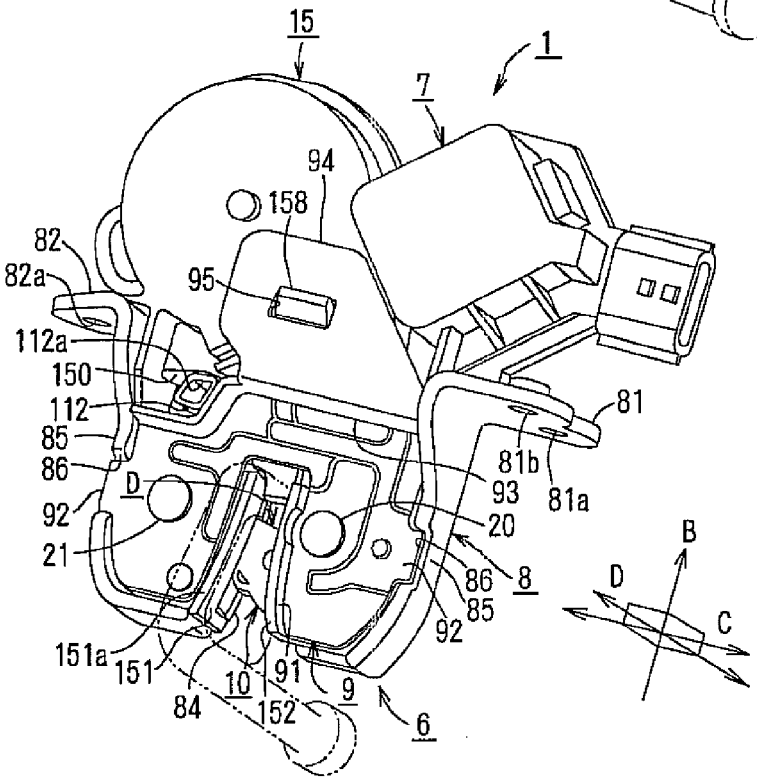
FIG. 6 is a front perspective view of the match device.

The flange 93 increases rigidity around the bottom of the striker-fitting groove 91 of the back plate 9. As shown in FIGS. 3, 6 and 8, the flange 93 engages between the side portions 85 and 85.

When load is applied to the latch device 1 in an opening direction, each edge of the flange 93 of the back plate 9 contacts the side portions 85,85 of the base plate 8 thereby preventing deformation of the back plate 9 and base plate 8 effectively not to disengage the latch 10 from the ratchet 11.

So, engagement strength of the latch 10 and ratchet 11 can be improved, With the flange 93, engagement between the latch 10 and the ratchet 11 can be improved by preventing deformation in the pivot direction D.

A projection 92 of the back plate 9 engages in a recess 86 of the base plate 8 to prevent the back plate 9 and the base plate 8 from moving to each other up and down. Thus, it can be kept at minimum to deform the base plate 8 and the back plate 9 for supporting the latch 10 and the ratchet 11, thereby increasing engagement strength of the latch 10 and the ratchet 11.

The holding portion 94 contacts the front surface of the housing 15. An opening 95 in the middle of the holding portion 94 engages with a projection 158 of the housing 15 thereby reinforcing the front of the housing 15.

The latch 10 is pivotally secured to the latch-connecting region 152 between the base 83 of the base plate 8 and the lower part of the housing 15 with a latch pivot 20 which extends in a direction perpendicular to the opening direction of the hatch door 3 or in the pivot direction D almost perpendicular to the striker-fitting direction B and the hinge-axis direction C.

When the hatch door 3 is open, the latch 10 is in an open position where the latch 10 disengages from the striker 4 in FIG. 11. When the hatch door 3 is closed, the latch 10 engages with the engagement rod 41 of the striker 4 which comes in the striker-fitting grooves 84,91,151 to turn in a counterclockwise direction by 90 degrees from the open position against the force of the latch spring 12 around the latch pivot 20 to a full-latch position in FIG. 10.

The ratchet 11 is pivotally secured with a ratchet pivot 21 in parallel with the latch pivot 20 to the ratchet-connecting region 153 between the base 83 of the base plate 8 and the lower part of the housing 15. When the hatch door 3 is closed, a claw 111 of the ratchet 11 engages with a claw 101 of the latch 10 to prevent the latch 10 from turning in the open direction thereby holding the hatch door 3 in the closed position. The ratchet 11 turns against the force of the ratchet spring 13 to a release position in FIG. 11 to allow the latch 10 to turn freely to the open position and to enable the hatch door 3 to open. When the ratchet 11 is in an engagement position, the lower end of the ratchet 11 contacts a stopper 25 made of rubber in the housing 15.

At the upper end of the ratchet 11, there is an engagement portion 113 which can engage with the other end 132 of the ratchet spring 13 of the spring-connecting region 1S6 as described later. At the upper end of the ratchet 11, there is an emergency-operating portion 112 which is exposed to the interior of the vehicle through an opening 150 of the housing 15.

The emergency-operating portion 112 is surrounded by an elastic member 24 such as rubber. The elastic member 24 reduces sound when the opening lever 14 strikes on the emergency-operating portion 112. The elastic member 24 also acts as a stopper 25 for limiting rotation of the ratchet 11. The elastic member 24 may be molded from resin together with the ratchet 11.

When the hatch door 3 is in the closed position, the opening lever 14 is released by the motor 17 to allow the side of the opening lever 14 to contact the elastic member 24 of the emergency-operating portion 112 to enable the ratchet 11 to be released.

If trouble in an electric system and others makes it impossible for the ratchet 11 to be released by the motor 17 in an emergency, the emergency-operating portion 112 exposed inside is manually operated in the interior of the vehicle without removing the trim of the hatch door, so that the ratchet 11 is disengaged from the latch 10 to allow the hatch door 3 to open quickly.

The emergency-operating portion 112 plays two roles of transmitting releasing of the opening lever 14 to the ratchet 11 and of working in an emergency thereby simplifying the shape of the ratchet 11 and entire structure.

The emergency-operating portion 112 is set not to protrude from the flange 93 of the back plate 9 in the interior. Thus, the emergency-operating portion 112 does not work mistakenly by hitting baggage directly onto the emergency-operating portion 112 in the interior.

The emergency-operating portion 112 has a recess 112*a* in which a rod-like tool such as a screwdriver can be put. The tool is inserted in the recess of the emergency-operating portion 112 to allow the ratchet 11 to be released easily.

The latch pivot 20 and ratchet pivot 21 pass through the base plate 8, housing 15 and back plate 9. The front ends of the pivots 20,21 are bent on the back plate 91 and the rear ends are bent around the end of the base plate 8. While the housing 15 is held between the base plate 8 and the back plate 9, the base plate 8, housing 15 and housing 9 are fixed to one another.

In FIG. 7, a striker-engaging part E of the latch 10 is set to coincide with a straight line L1 which passes through the centers of the female thread bores 81*a*,82*a* of the mounting portions 81,82 seen from the striker-fitting direction B.

Furthermore, in FIG. 8, an engagement part F in which the claw 101 of the latch 10 engages with the claw 111 of the ratchet 11 is set to coincide with the straight line L1.

Accordingly, in case that opening load acts between the latch device 1 and the striker 4 when the hatch door 3 is closed, load W which acts to a bound part between the base plate 8 and the hatch door 3 via the latch 10 and the ratchet 11 acts straight to the bolts 5 engaging with the female threads 81*a*,82*a*, thereby reducing deformation of the mounting surface 32 of the inner panel 31 in the hatch door 3 and the mounting portions 81,82 of the base plate 8 at minimum and increasing strength of the latch device 1.

For example, if the load W obliquely acts onto the bolts 5 or to a position away from the straight line L1, the surface 32 and the mounting portions 81,82 are deformed obliquely thereby decreasing strength.

The worm wheel 19 is pivotally secured to the worm-wheel-connecting region 155 between the upper end of the housing 15 and the cover 16 with a worm-wheel pivot 22 in parallel with the latch pivot 20 and is always forced to a neutral position by a spring (not shown) around the worm-wheel pivot 22.

In FIGS. 10 and 11, the motor 17 is disposed in the motor-connecting region 154 between the upper end of the housing 15 and the cover 16 such that the shaft 171 is inclined. That is, the axis L3 of the shaft 171 goes between the ratchet pivot 21 and the worm-wheel pivot 22 and crosses obliquely with respect to the boarder line L2.

The worm 18 reversibly meshes with a gear 191 on the outer circumference of the worm wheel 19 and rotates by the motor 17 to allow the worm wheel 19 to turn from the standby position in a releasing direction or in a counterclockwise direction in FIGS. 10, 11 and 13. The worm wheel 19 rotates in the releasing direction and the turning-position sensor 23 detects an open position of the latch 10, so that the motor 17 stops. The worm wheel 19 returns to the neutral position by the spring and stops.

The opening lever 14 is pivotally secured with the ratchet pivot 21 coaxial with the ratchet 11 such that it can swing separately from the ratchet 11. The opening lever 14 crosses the axis L3 of the shaft 171 over the worm 18. A sector gear 141 of the opening lever 14 meshes with a smaller gear 192 of the worm wheel 19.

When the hatch door 3 is closed, the worm wheel 19 turns from the neutral position in the releasing direction by the motor 17. Thus, the opening lever 14 swings from the standby position in FIG. 10 in the releasing direction or clockwise direction in FIG. 10 to the releasing position in FIG. 11. The side edge of the opening lever 14 contacts the emergency-operating portion 112 via the elastic member 24 on the outer circumferential surface of the emergency-operating portion 112 to let the ratchet 11 swing from the engagement position to the releasing position. Specifically, by a switch (not shown) on the outer surface of the hatch door 3 when the hatch door 3 is closed, the motor 17 is driven, and power of the motor 17 is transmitted to the ratchet 11 via the opening lever 14 and the emergency-operating portion 112 thereby having the ratchet 11 released so that the hatch door 3 can be opened.

The hatch door 3 is opened to make the motor 17 to stop. Thus, the worm wheel 19 returns to the neutral position and the opening lever returns to the standby position.

When the opening lever 14 and the ratchet 11 are in the standby position and in the engagement position respectively, the side edge of the opening lever 14 contacts the elastic member 24 about the emergency-operating portion 112 of the ratchet 11. Accordingly, the opening lever 14 is prevented from loosening caused by backlash of the engagement between the sector gear 141 of the opening lever 14 and the smaller gear 192 of the worm wheel 19.

The ratchet spring 13 comprises a coil spring, a coiled part of which is wound around an axial part 159*a* of the spring-connecting region 156. One end of the spring 13 is fixed to an engagement portion 159*b* near the axial portion 159*a*, while the other or free end 132 engages with an engagement portion 113 of the ratchet 11 in the pivot direction D thereby applying force in an engagement direction to the ratchet 11. The coiled portion 131 is disposed out of an operation area of the ratchet 11 and the opening lever 14 not to contact the ratchet 11 and the opening lever 14.

By such arrangement, the latch 10, the ratchet 11, the motor 17, the worm wheel 19 and the opening lever 14 are gathered at optimum position thereby reducing the sizes of the striker-fitting direction B and hinge-axis direction C and thickness of the pivot direction D to make the whole size of the latch device 1 smaller.

Particularly, the motor 17 is tilted in the motor-connecting region 154, the ratchet spring 13 can be easily connected to the spring-connecting region 156 between the motor 17 and the latch 10. Also, a space between the motor 17 and the latch 10 can be efficiently employed for mounting the ratchet spring 13 to make the latch device 1 smaller.

The ratchet spring 13 is not overlapped on the latchet 11 and the opening lever 14 in the pivot direction D thereby reducing thickness of the pivot direction of the latch device 1. Furthermore, the other end 132 of the ratchet spring 13 engages with the engagement portion 113 of the ratchet 11 in the pivot direction D, thereby achieving firm engagement of the other end 132 of the ratchet spring 13 with the ratchet 11.

The turning-position sensor 23 is disposed in the spring-connecting region 156 and a detecting portion 231 is in sliding contact with the outer circumferential surface of the latch 10 to detect a turning position of the latch 10.

Then, how to assemble the latch device 1 will be described.

First, the front ends of the latch pivot 20 and the ratchet pivot 21 are bent and fixed to the back plate 9. Thereafter, the back plate 9 contacts the front surface of the housing 15 to allow the latch pivot 20 and ratchet pivot 21 to project from the rear surface of the housing 15.

Figure 14:
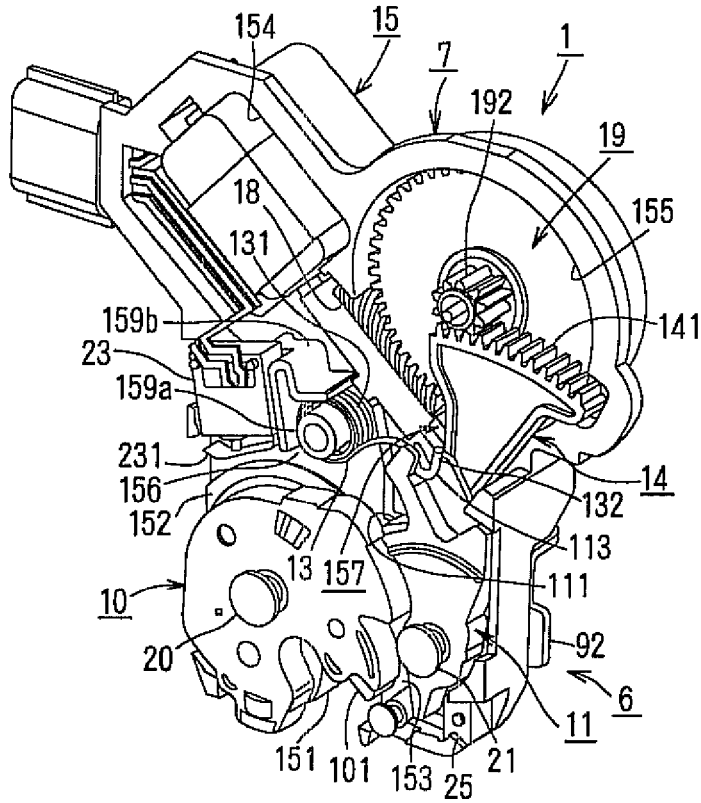
FIG. 14 is a perspective view of the latch device from which a cover and a base plate are removed.
Figure 15:
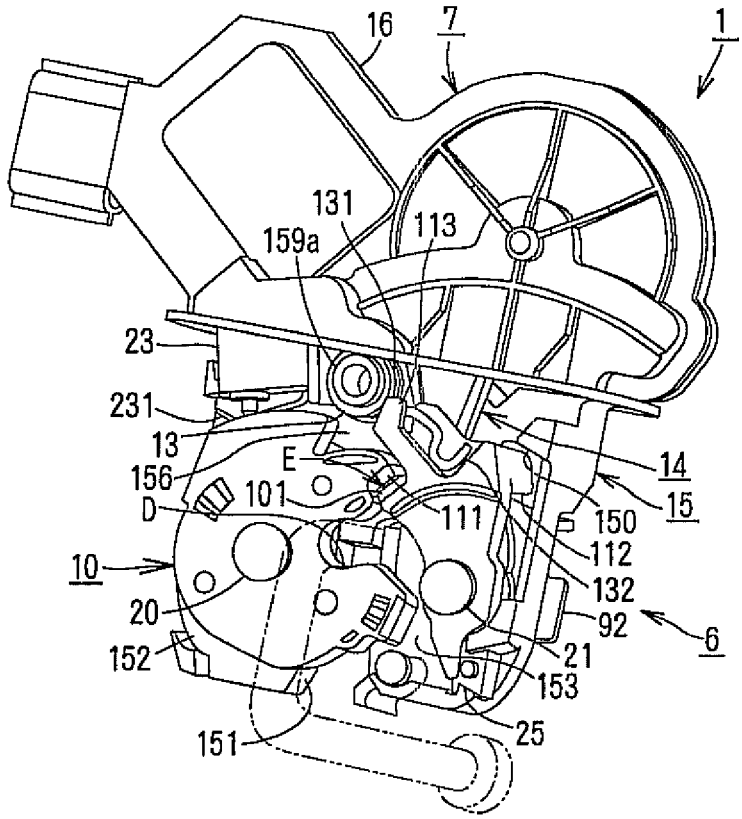
FIG. 15 is a perspective view of the latch device from which the base plate is removed.
Figure 16:
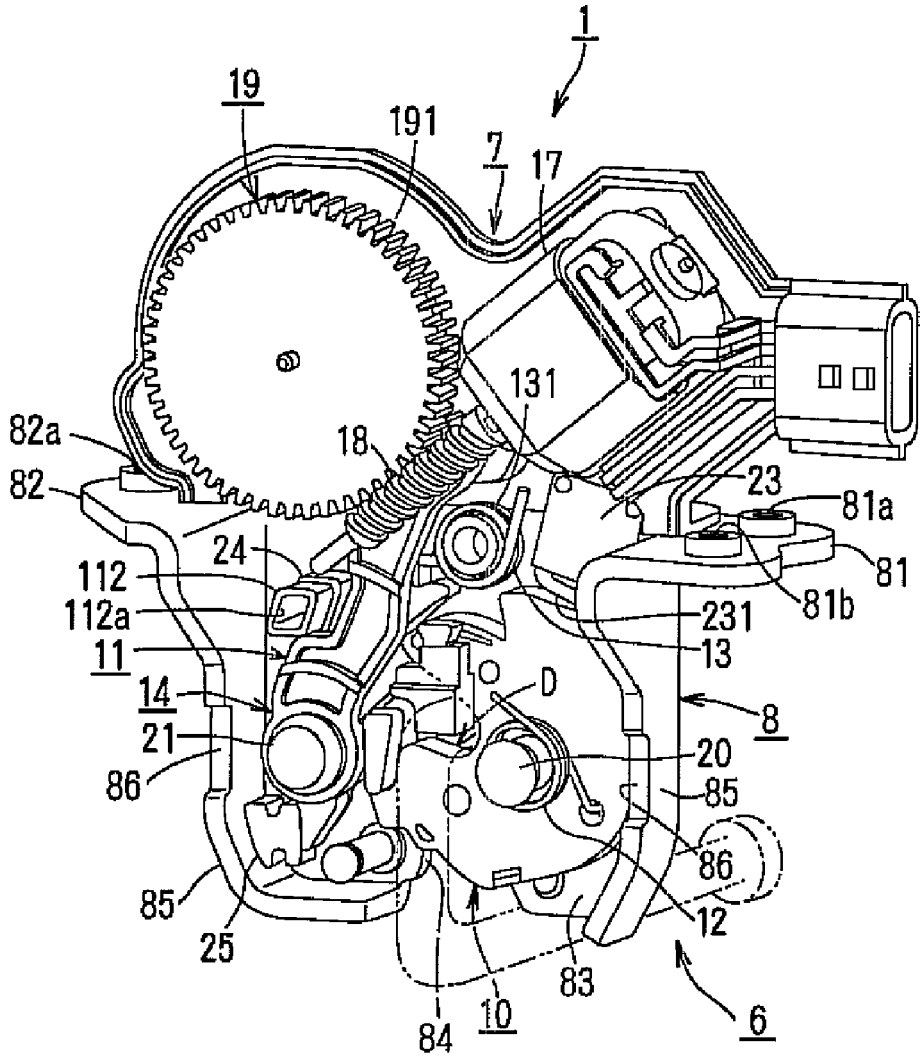
FIG. 16 is a perspective view of the latch device from which the housing is removed.

In FIG. 14, the latch 10, ratchet 11, latch spring 12, ratchet spring 13, opening lever 14, motor 17, worm wheel 19 and turning-position sensor 23 are mounted to the housing 15 and the upper rear surface of the housing 15 is closed by the cover 16. Then, the base plate 8 is mounted to the lower rear surface of the housing 15 and the rear ends of the latch pivot 20 and ratchet pivot 21 which project from the base plate 8 are bent and fixed. So the latch device 1 is finally assembled.

The foregoing merely relate to embodiments of the invention. Various changes and modifications may be made by a person skilled in the art without departing from the scope of claims, as below:

(i) The latch device 1 may be applied to other doors such as a side door which opens and closes about a vertical hinge shaft to a vehicle body.

(ii) The latch device 1 may be mounted to the vehicle body, while the striker 4 may be mounted to a door.

(iii) The base plate 8 is integrally formed with the housing 15, or the housing 15 may be integrally formed with the back plate 9.

What is claimed is:

1. A door latch device for a vehicle comprising a door which is capable of being opened and closed about a hinge axis of a vehicle body, the device enabling the door to be held in a closed position, said device comprising:

a striker mounted to the vehicle body;

a base plate having a striker-fitting groove and being mounted to the door, the base plate comprising a first mounting portion and a second mounting portion which are aligned and define a first plane that is transverse to a striker-engaging direction and a plurality of recesses, the striker-engaging direction being defined as a direction in which the striker engages with the latch within the striker-fitting groove, the striker-fitting groove being formed between the first mounting portion and the second mounting portion;

a latch pivot mounted to the base plate;

a latch pivotally secured to the base plate via the latch pivot, the latch engaging with the striker, when the striker is located within the striker-fitting groove of the base plate, to hold the door in the closed position;

a ratchet pivot mounted to the base plate;

a ratchet pivotally secured to the base plate via the ratchet pivot, the latch engaging with the striker to allow the ratchet to engage with the latch to prevent the latch from turning;

a back plate having a plurality of projections engaged with the plurality of recesses of the base plate to house the latch pivot, the latch, the ratchet pivot and the ratchet between the base plate and the back plate;

a first bolt provided in the first mounting portion of the base plate; and a second bolt provided in the second mounting portion of the base plate, the first and the second bolts mounting the base plate to a mounting surface of an inner panel of the door, the first and the second bolts each comprise a longitudinal axis that is parallel to the striker-engaging direction and normal to the first plane, the longitudinal axes of the first and the second bolts define a second plane and intersect the first plane at points which together define a straight line, the striker-fitting groove being positioned between the longitudinal axes of the first and the second bolts when viewed from a position normal to the first plane, the latch engages the striker at a point in the straight line between the first and the second bolts, the ratchet engaging the latch in the straight line between the first and the second bolts, the straight line being parallel to the hinge axis at least when the latch engages with the striker, the latch and the ratchet being aligned such that side surfaces of the latch and the ratchet are parallel with the second plane, and the first and the second mounting portions of the base plate being connected to the mounting surface of the door, via the first and the second bolts, with the striker-fitting groove located between the first and the second bolts when viewed from the position on the second plane and normal to the first plane, and a driving portion that comprises a motor, a worm fixed to a shaft of the motor and a worm wheel which meshes with the worm and is connected to the ratchet, the worm being driven by the motor so that the worm wheel makes the ratchet disengage from the latch, the driving portion being partially disposed between the base plate and the back plate under the first plane defined between the first and the second mounting portions.

2. The door latch device of claim 1 wherein a third bolt for mounting the base plate to the inner panel of the door is provided away from the straight line.

3. A door latch device for a vehicle comprising a door which is capable of being opened and closed about a hinge axis of a vehicle body, the device enabling the door to be held in a closed position, said device comprising:

a striker mounted to the vehicle body;

a base plate having a striker-fitting groove and being mounted to the door, the base plate comprising a first mounting portion and a second mounting portion which are aligned and define a first plane that is transverse to a striker-engaging direction and a plurality of recesses, the striker-engaging direction being defined as a direction in which the striker engages with the latch within the striker-fitting groove, the striker-fitting groove being formed between the first mounting portion and the second mounting portion;

a latch pivot mounted to the base plate;

a latch pivotally secured to the base plate via the latch pivot, the latch engaging with the striker, when the striker is located within the striker-fitting groove of the base plate, to hold the door in the closed position;

a ratchet pivot mounted to the base plate;

a ratchet pivotally secured to the base plate via the ratchet pivot, the latch engaging with the striker to allow the ratchet to engage with the latch to prevent the latch from turning;

a back plate having a plurality of projections engaged with the plurality of recesses of the base plate to house the latch pivot, the latch, the ratchet pivot and the ratchet between the base plate and the back plate;

a first bolt provided in the first mounting portion of the base plate; and a second bolt provided in the second mounting portion of the base plate, the first and the second bolts mounting the base plate to a mounting surface of an inner panel of the door, the first and the second bolts each comprise a longitudinal axis that is parallel to the striker-engaging direction and normal to the first plane, the longitudinal axes of the first and the second bolts define a second plane and intersect the first plane at points which together define a straight line, the striker-fitting groove being positioned between the longitudinal axes of the first and the second bolts when viewed from a position normal to the first plane, the latch engages the striker at a point in the straight line between the first and the second bolts, the ratchet engaging the latch in the straight line between the first and the second bolts, the straight line being parallel to the hinge axis at least when the latch engages with the striker, the latch and the ratchet being aligned such that side surfaces of the latch and the ratchet are parallel with the second plane, and the first and the second mounting portions of the base plate being connected to the mounting surface of the door, via the first and the second bolts, with the striker-fitting groove located between the first and the second bolts when viewed from the position on the second plane and normal to the first plane, and a driving portion that comprises a motor, a worm fixed to a shaft of the motor and a worm wheel which meshes with the worm and is connected to the ratchet, the worm being driven by the motor so that the worm wheel makes the ratchet disengage from the latch, the worm extends between the base plate and the back plate through the first plane defined between the first and the second mounting portions.

* * * * *